US012092112B2

(12) United States Patent
Sasa et al.

(10) Patent No.: US 12,092,112 B2
(45) Date of Patent: Sep. 17, 2024

(54) HERMETIC ELECTRIC COMPRESSOR

(71) Applicant: Panasonic Intellectual Property Management Co., Ltd., Osaka (JP)

(72) Inventors: Takuji Sasa, Shiga (JP); Daisuke Ogi, Shiga (JP); Kazuya Sato, Gunma (JP); Tsutomu Kon, Gunma (JP); Takashi Higashida, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 105 days.

(21) Appl. No.: 17/907,041

(22) PCT Filed: Jun. 18, 2021

(86) PCT No.: PCT/JP2021/023180
§ 371 (c)(1),
(2) Date: Sep. 22, 2022

(87) PCT Pub. No.: WO2022/070527
PCT Pub. Date: Apr. 7, 2022

(65) Prior Publication Data

US 2023/0121207 A1 Apr. 20, 2023

(30) Foreign Application Priority Data

Sep. 29, 2020 (JP) ..... 2020-162886

(51) Int. Cl.
*F04C 29/02* (2006.01)
*F04B 39/04* (2006.01)
(Continued)

(52) U.S. Cl.
CPC ..... *F04C 29/026* (2013.01); *F04B 39/04* (2013.01); *F04B 39/123* (2013.01); *F04C 29/06* (2013.01); *F04C 29/12* (2013.01)

(58) Field of Classification Search
CPC ..... F04B 39/04; F04B 39/123; F04C 29/12; F04C 29/06
See application file for complete search history.

(56) References Cited

U.S. PATENT DOCUMENTS 11,692,547 B2 * 7/2023 Park ..... F04C 18/0215 418/55.1
2020/0318771 A1 * 10/2020 Houguchi ..... F04B 39/123
2022/0106952 A1 * 4/2022 Nozaki ..... F04C 29/02

FOREIGN PATENT DOCUMENTS

EP 3670918 A1 6/2020
JP 57-152489 U 9/1982
(Continued)

OTHER PUBLICATIONS

International Search Report and Written Opinion, International Patent Application No. PCT/JP2021/023180, Aug. 24, 2021, with English translation of Search Report (11 pages).

*Primary Examiner* — Christopher S Bobish
(74) *Attorney, Agent, or Firm* — HSML P.C

(57) ABSTRACT

According to a hermetic electric compressor of the present invention, a discharge port 66*a* is placed downstream of eddying flow from the joint portion 66*b*, a bent portion 66*c* is formed between the joint portion 66*b* and the discharge port 66*a*, an imaginary plumb line 66*a*Y of an opening surface formed on the discharge port 66*a* is oriented to a circumferential direction of a hermetic container 10, and fluid having a small lubrication oil content is taken out from the discharge port 66*a* utilizing eddying flow of mixture fluid of refrigerant and lubrication oil in a gap space between a compressing mechanism 20 and a motor section 30, thereby reducing a discharge amount from the hermetic container 10.

6 Claims, 4 Drawing Sheets

(51) Int. Cl.

| | |
|---|---|
| ***F04B 39/12*** | (2006.01) |
| ***F04C 29/06*** | (2006.01) |
| ***F04C 29/12*** | (2006.01) |

(56) References Cited

FOREIGN PATENT DOCUMENTS

| | | | |
|---|---|---|---|
| JP | 58-156183 | U | 10/1983 |
| JP | 63-97894 | A | 4/1988 |
| JP | 3-70894 | A | 3/1991 |
| JP | 2006-132377 | A | 5/2006 |
| JP | 2007-218214 | A | 8/2007 |
| JP | 2020-133523 | A | 8/2020 |

* cited by examiner

[Fig 1]
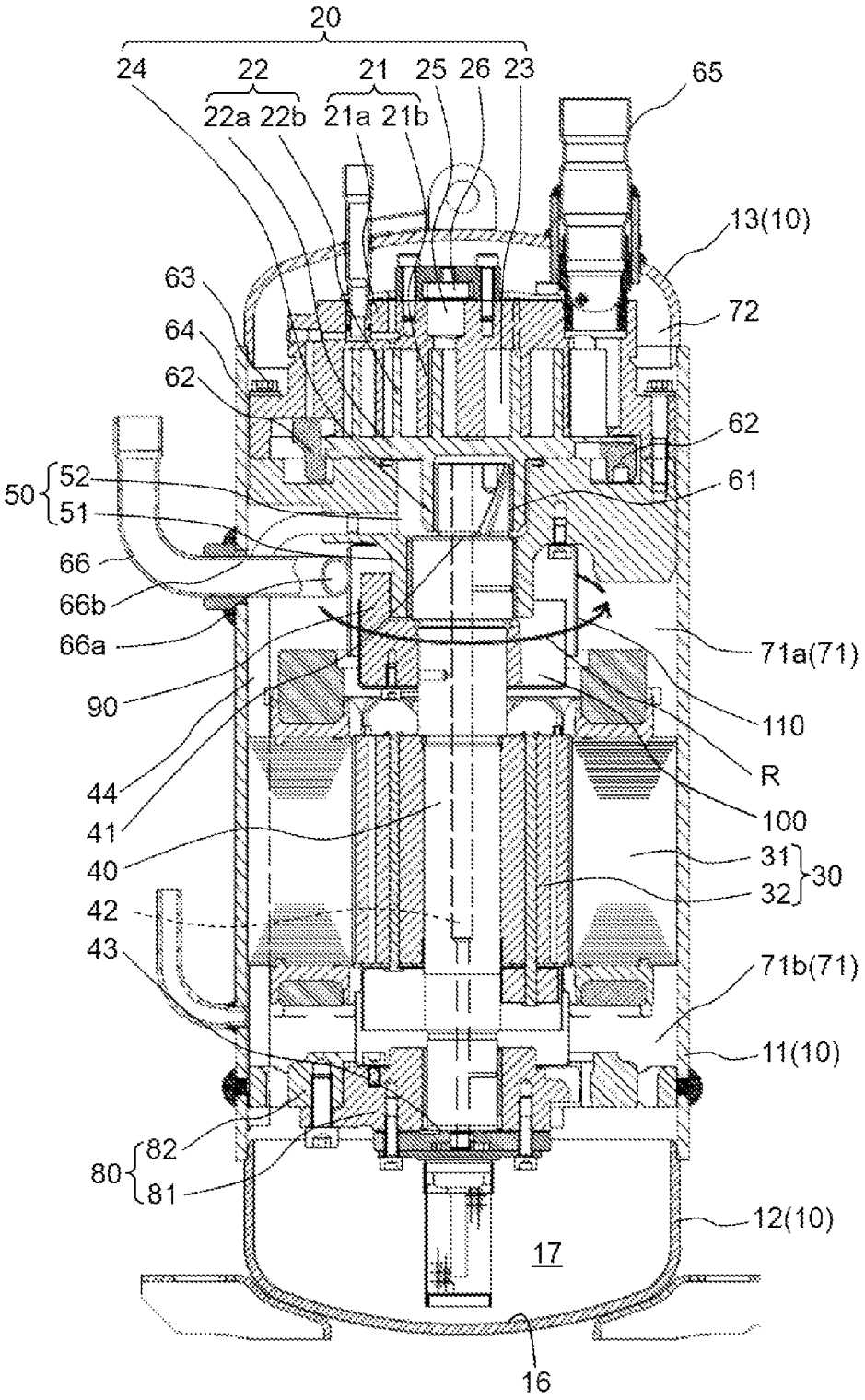

[Fig 2]
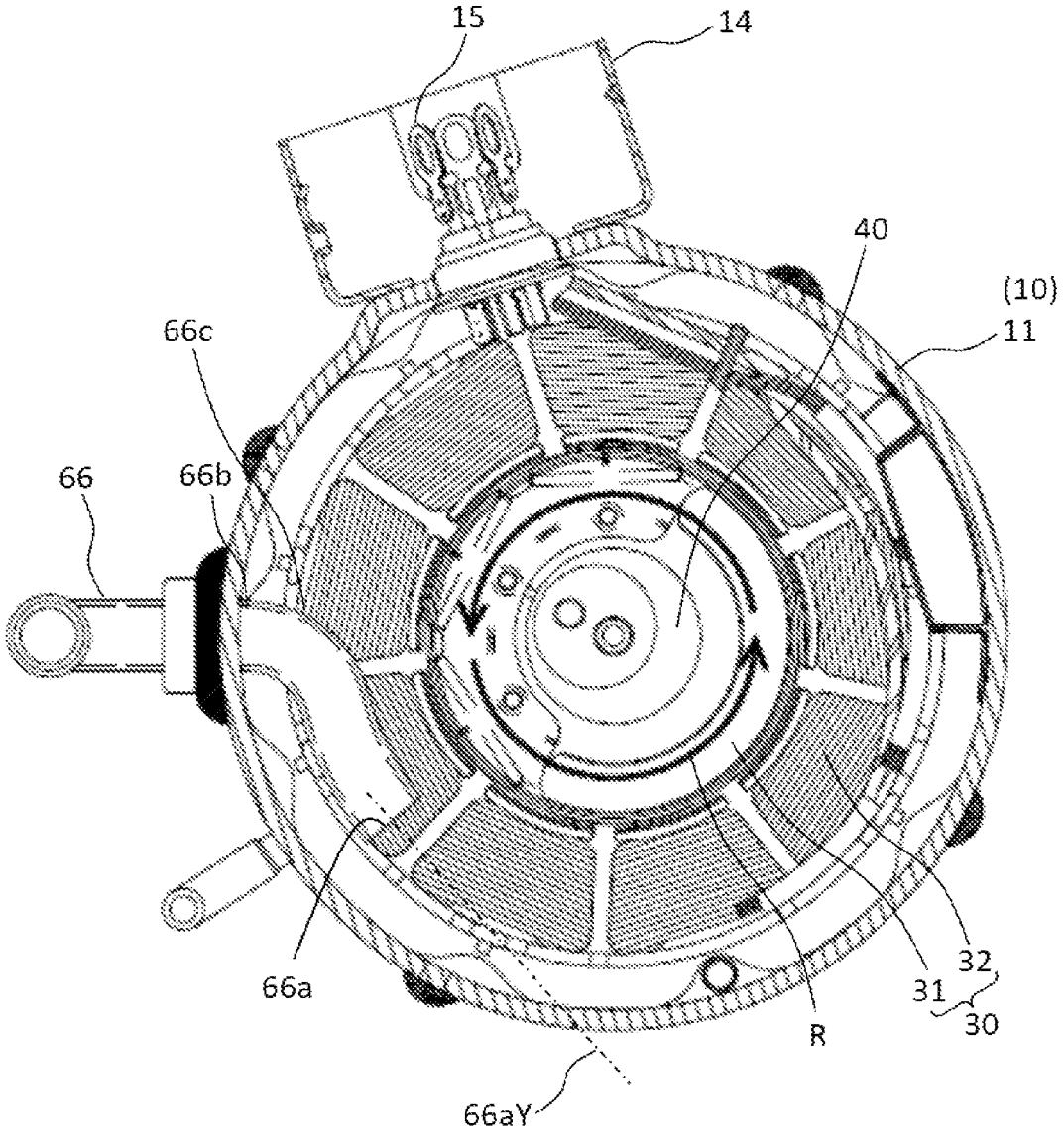

[Fig 3]
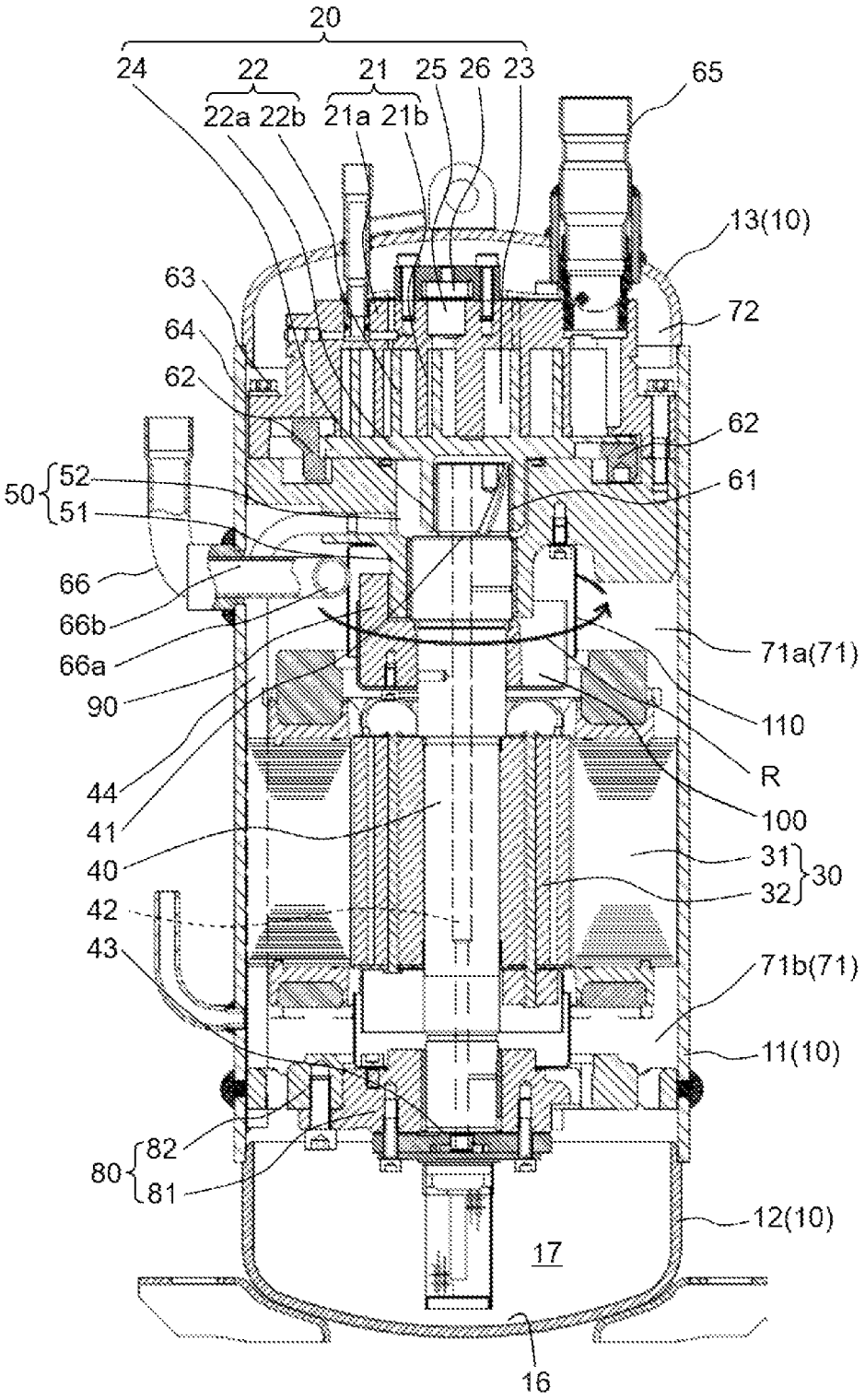

[Fig 4]
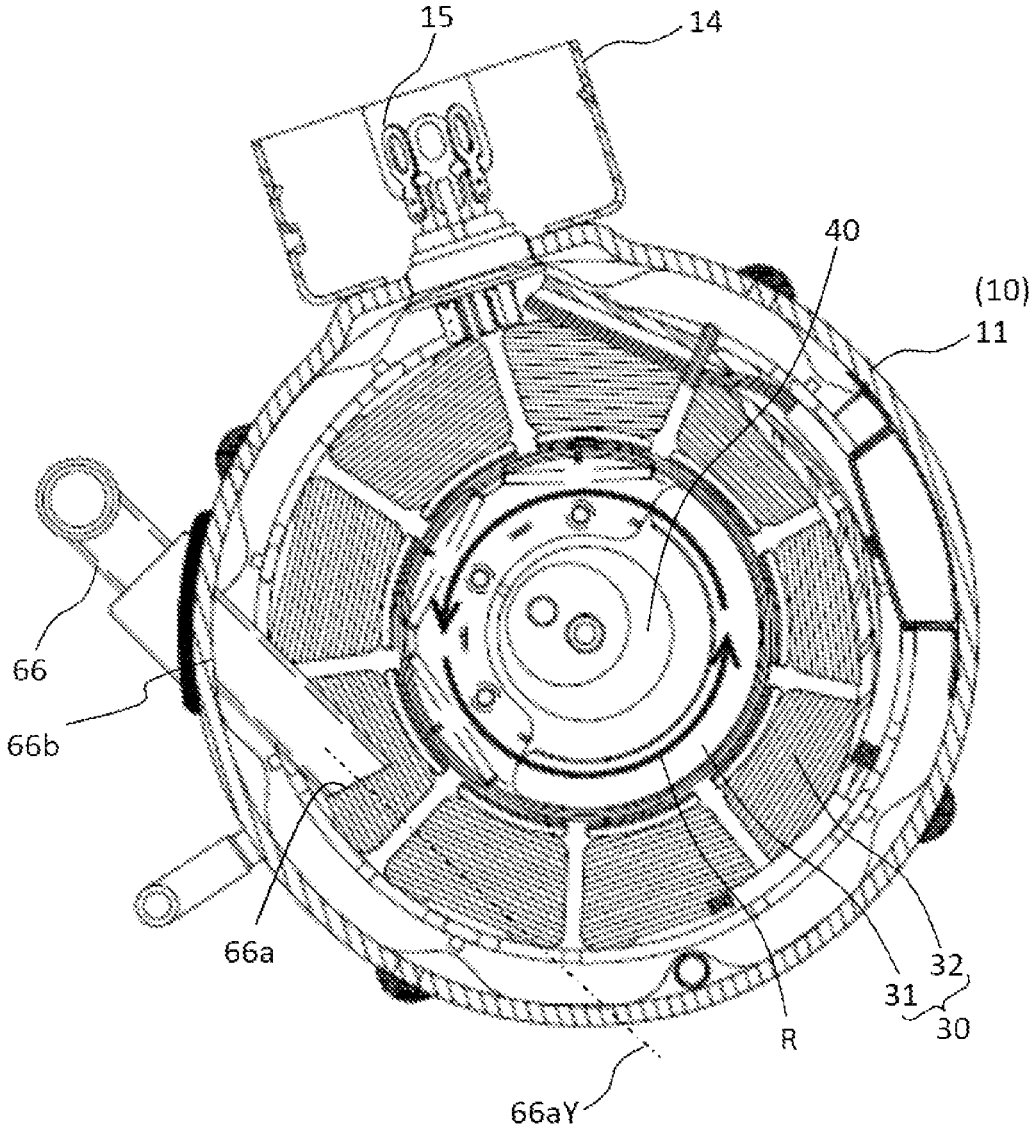

HERMETIC ELECTRIC COMPRESSOR

TECHNICAL FIELD

The present invention relates to a hermetic electric compressor used in an outdoor unit of an air conditioner and a freezing machine.

BACKGROUND TECHNIQUE

Patent document 1 shows a hermetic electric compressor having a compressing mechanism and a motor section in a hermetic container, a discharge pipe is placed in a space between the compressing mechanism and the motor section, and it is an object of the patent document 1 to reduce a discharge amount of lubrication oil discharged from the discharge pipe to outside of the hermetic container.

In the patent document 1, refrigerant collides against a recess provided in an outer surface of a motor coil end to separate the lubrication oil from the refrigerant, thereby reducing the discharge amount from the hermetic container.

PRIOR ART DOCUMENT

Patent Document

[Patent Document 1]

Japanese Patent Application Laid-open No. 2007-218214

SUMMARY OF THE INVENTION

Problem to be Solved by the Invention

In the patent document 1, since a discharge port of the discharge pipe is provided in a radial direction of the hermetic container, when the lubrication oil is not sufficiently separated from the refrigerant by colliding the refrigerant against the recess provided in the outer surface of the motor coil end, the lubrication oil is discharged from the discharge pipe together with the refrigerant.

Hence, it is an object of the present invention to provide a hermetic electric compressor capable of reducing the discharge amount from the hermetic container by taking fluid having a small lubrication oil content from the discharge port utilizing eddying flow of mixture fluid of the refrigerant and the lubrication oil in the gap space between the compressing mechanism and the motor section.

Means for Solving the Problem

A hermetic electric compressor of the present invention described in claim 1 includes a compressing mechanism 20 and a motor section 30 provided in a hermetic container 10, the compressing mechanism 20 and the motor section 30 are connected to each other through a drive shaft 40, the compressing mechanism 20 is placed on one of sides in the hermetic container 10, the motor section 30 is placed on an other side in the hermetic container 10, a discharge pipe 66 is placed in a gap space 71*a* between the compressing mechanism 20 and the motor section 30, a discharge port 66*a* of the discharge pipe 66 extends into the gap space 71*a* from a joint portion 66*b* between the discharge pipe 66 and the hermetic container 10, the drive shaft 40 is pivotally supported by a bearing portion 51, an oil reservoir 17 is formed in an inner bottom 16 of the hermetic container 10, an oil supply passage 42 which guides lubrication oil stored in the oil reservoir 17 into the compressing mechanism 20 and the bearing portion 51, 80 is formed in the drive shaft 40, refrigerant compressed in the compressing mechanism 20 is discharged into the hermetic container 10, and the refrigerant discharged into the hermetic container 10 becomes eddying flow in the gap space 71*a* by rotation of the drive shaft 40, and is discharged to outside of the hermetic container 10 from the discharge pipe 66, wherein the discharge port 66*a* is placed downstream of the eddying flow from the joint portion 66*b*.

According to a hermetic electric compressor of the invention described in claim 2, in the hermetic electric compressor of claim 1, a bent portion 66*c* is formed between the joint portion 66*b* and the discharge port 66*a*.

According to a hermetic electric compressor of the invention described in claim 3, in the hermetic electric compressor of claim 2, in the joint portion 66*b*, the discharge pipe 66 is vertically jointed to the hermetic container 10.

According to a hermetic electric compressor of the invention described in claim 4, in the hermetic electric compressor of claim 1, in the joint portion 66*b*, the discharge pipe 66 is obliquely jointed to the hermetic container 10.

According to a hermetic electric compressor of the invention described in claim 5, in the hermetic electric compressor of claim 4, the discharge pipe 66 from the joint portion 66*b* to the discharge port 66*a* is formed as a straight pipe.

According to a hermetic electric compressor of the invention described in claim 6, in the hermetic electric compressor of any one of claims 1 to 5, an imaginary plumb line 66*a*Y of an opening surface formed on the discharge port 66*a* is oriented to a circumferential direction of the hermetic container 10.

Effect of the Invention

According to the present invention, the discharge port of the discharge pipe is placed downstream of the eddying flow from the joint portion, and the discharge port is provided in a direction opposite from the eddying flow. Therefore, fluid having a small lubrication oil content can be taken out from the discharge port utilizing the eddying flow of the mixture fluid of the refrigerant and the lubrication oil in the gap space between the compressing mechanism and the motor section, and the discharge amount from the hermetic container can be reduced.

BRIEF DESCRIPTION OF THE DRAWINGS

FIG. 1 is a sectional view of an essential portion of a side surface of a hermetic electric compressor according to an embodiment of the present invention;

FIG. 2 is a sectional view of an essential portion of a plane of the hermetic electric compressor;

FIG. 3 is a sectional view of an essential portion of a side surface of a hermetic electric compressor according to another embodiment of the invention; and FIG. 4 is a sectional view of an essential portion of a plane of the hermetic electric compressor.

MODE FOR CARRYING OUT THE INVENTION

In a hermetic electric compressor of a first embodiment of the present invention, a discharge port is placed downstream of eddying flow from a joint portion. Lubrication oil is mixed in refrigerant compressed by a compressing mechanism and discharged into a hermetic container, and the lubrication oil becomes the eddying flow in a gap space between the compressing mechanism and a motor section together with the refrigerant. According to the embodiment, the discharge port of the discharge pipe is placed downstream of the eddying flow from the joint portion, and the discharge port is provided in a direction opposite from the eddying flow. Therefore, fluid having a small lubrication oil content can be taken out from the discharge port utilizing the eddying flow of the mixture fluid of the refrigerant and the lubrication oil in the gap space between the compressing mechanism and the motor section, and the discharge amount from the hermetic container can be reduced.

According to a second embodiment of the invention, in the hermetic electric compressor of the first embodiment, a bent portion is formed between the joint portion and the discharge port. According to the second embodiment, by forming the bent portion, it is possible to place the discharge port of the discharge pipe downstream of the eddying flow from the joint portion, and to provide the discharge port in a direction opposite from the eddying flow.

According to a third embodiment, in the hermetic electric compressor of the second embodiment, in the joint portion, the discharge pipe is vertically jointed to the hermetic container. According to the third embodiment, the discharge pipe can easily be jointed to the hermetic container.

According to a fourth embodiment, in the hermetic electric compressor of the first embodiment, in the joint portion, the discharge pipe is obliquely jointed to the hermetic container. According to the fourth embodiment, by jointing the discharge pipe obliquely to the hermetic container, it is possible to place the discharge port of the discharge pipe downstream of the eddying flow from the joint portion, and to provide the discharge port in the direction opposite from the eddying flow.

According to a fifth embodiment, in the hermetic electric compressor of the fourth embodiment, the discharge pipe 66 from the joint portion to the discharge port is formed as a straight pipe. According to the fifth embodiment, a bending operation of the discharge pipe is unnecessary, and the discharge pipe can easily be inserted into the hermetic container.

According to a sixth embodiment, in the hermetic electric compressor of any one of the first to fifth embodiments, an imaginary plumb line of an opening surface formed in the discharge port is oriented to a circumferential direction of the hermetic container. According to the sixth embodiment, fluid having a small lubrication oil content can be taken out from the discharge port utilizing the eddying flow of the mixture fluid of the refrigerant and the lubrication oil in the gap space between the compressing mechanism and the motor section, and the discharge amount from the hermetic container can be reduced.

EMBODIMENTS

An embodiment of the present invention will be described below with reference to the drawings.

FIG. 1 is a sectional view of an essential portion of a side surface of a hermetic electric compressor according to the embodiment, and FIG. 2 is a sectional view of an essential portion of a plane of the hermetic electric compressor. This embodiment will be described using a scroll hermetic electric compressor which is placed vertically.

A hermetic container 10 is formed from a cylindrical trunk shell 11 having an axis in a vertical direction, a bowl-shaped lower shell 12 which is air-tightly welded to a lower end of the trunk shell 11, and a bowl-shaped upper shell 13 which is air-tightly welded to an upper end of the trunk shell 11. A terminal cover 14 (see FIG. 2) is provided on an outer peripheral surface of the hermetic container 10, and a power source supply terminal 15 is provided in the terminal cover 14. The power source supply terminal 15 supplies power source to a motor section 30. An oil reservoir 17 is formed in an inner bottom 16 of the hermetic container 10.

A compressing mechanism 20 and the motor section 30 are provided in the hermetic container 10. The compressing mechanism 20 is placed on one of sides in the hermetic container 10, and the motor section 30 is placed on the other side in the hermetic container 10. The compressing mechanism 20 is placed above the motor section 30. The compressing mechanism 20 and the motor section 30 are connected to each other through a drive shaft 40.

The compressing mechanism 20 is composed of a fixed scroll 21 and an orbiting scroll 22.

The fixed scroll 21 is composed of a panel plate 21*a* and an involute lap 21*b* formed on a lower surface of the panel plate 21*a*.

The orbiting scroll 22 is composed of a panel plate 22*a* and an involute lap 22*b* formed on an upper surface of the panel plate 22*a*. A cylindrical boss 24 is provided on a center of a lower surface of the panel plate 22*a* of the orbiting scroll 22.

The lap 21*b* of the fixed scroll 21 and the lap 22*b* of the orbiting scroll 22 mesh with each other. A plurality of compression chambers 23 are formed between the fixed scroll 21 and the orbiting scroll 22 by both the laps 21*b* and 22*b*.

A discharge hole 25 is provided in a central portion of the panel plate 21*a* of the fixed scroll 21, and a discharge valve 26 is provided in the discharge hole 25.

The motor section 30 is composed of an annular stator 31 and a rotor 32 which is rotatably provided on an inner side of the stator 31. The stator 31 is fixed to an inner peripheral surface of the hermetic container 10. The rotor 32 is fixed to the drive shaft 40.

An eccentric shaft 41 is formed on an upper end of the drive shaft 40. An axil of the eccentric shaft 41 is eccentric from an axis of the drive shaft 40. A displacement oil pump 43 is provided on a lower end of the drive shaft 40. An oil supply passage 42 is formed in the drive shaft 40. The oil supply passage 42 guides lubrication oil stored in the oil reservoir 17 to the compressing mechanism 20 and bearing portions (main bearing 51 and auxiliary bearing 80). An oil-returning pipe 44 is connected to a boss-accommodating section 52. Lubrication oil guided from the compressing mechanism 20 to the boss-accommodating section 52 is guided to a lower portion in the hermetic container 10 by the oil-returning pipe 44.

A main frame 50 is provided in an upper portion in the hermetic container 10. The compressing mechanism 20 is placed on an upper portion of the main frame 50.

The main bearing (bearing portion) 51 and the boss-accommodating section 52 are formed at center portions of the main frame 50, and they are fixed to the inner peripheral surface of the hermetic container 10. The main bearing 51 projects downward cylindrically from a central portion of a lower surface of the main frame 50, and the main bearing 51 pivotally supports an upper end of the drive shaft 40. The boss-accommodating section 52 is formed as a hollow downwardly extending from a central portion of an upper surface of the main frame 50, and the boss-accommodating section 52 accommodates the boss 24. The eccentric shaft 41 is inserted into the boss 24 through a turning bearing 61.

The orbiting scroll 22 is placed between the fixed scroll 21 and the main frame 50. The fixed scroll 21 is fastened to an upper surface of the main frame 50 by screws 63. An Oldham ring 62 is placed between the orbiting scroll 22 and the main frame 50, and rotation of the orbiting scroll 22 is restrained by the Oldham ring 62.

An interior of the hermetic container 10 is partitioned into a high pressure space 71 formed below the main frame 50 and a discharge space 72 formed above the main frame 50. The high pressure space 71 is formed from a gap space 71*a* formed between the main frame 50 and the motor section 30, and a lower high pressure space 71*b* formed between the motor section 30 and the inner bottom 16 of the hermetic container 10.

The discharge space 72 and the gap space 71*a* are in communication with each other through a vertical groove 64. The gap space 71*a* and the lower high pressure space 71*b* are in communication with each other through a communication hole formed in the stator 31 and a gap between the stator 31 and the rotor 32.

A suction pipe 65 which guides low pressure refrigerant to the compression chambers 23 is connected to the upper shell 13 of the hermetic container 10. A discharge pipe 66 which discharges high pressure refrigerant in the hermetic container 10 to outside of the hermetic container 10 is connected to the trunk shell 11 of the hermetic container 10. A discharge port 66*a* of the discharge pipe 66 is placed in the gap space 71*a*.

The auxiliary bearing (bearing portion) 80 which pivotally supports a lower end of the drive shaft 40 is provided below the motor section 30. The auxiliary bearing 80 includes a cylindrical boss section 81 into which the drive shaft 40 is inserted, and an arm section 82 extending from the boss section 81 in an outer circumferential direction and fixed to an inner peripheral surface of the hermetic container 10.

The drive shaft 40 is provided with a balancer 90. The balancer 90 is located below the compressing mechanism 20 and above the motor section 30.

An oil-receiving member 100 is provided on an outer periphery of the balancer 90. The oil-receiving member 100 receives lubrication oil which drops toward the motor section 30.

A cover 110 covering a circumference of the balancer 90 is provided on a lower surface of the main frame 50.

Lubrication oil in the oil reservoir 17 is pumped up into the oil supply passage 42 by the displacement oil pump 43. The lubrication oil pumped up by the oil supply passage 42 is supplied from a lateral hole 42*a* into the main bearing 51, and is supplied from an upper end opening 42*b* of the drive shaft 40 into the boss 24.

The lubrication oil supplied into the boss 24 is supplied to sliding surface of the compressing mechanism 20 and the Oldham ring 62.

The lubrication oil supplied to the compressing mechanism 20 and the main bearing 51 flows into the boss-accommodating section 52. The lubrication oil which flows into the boss-accommodating section 52 passes through the oil-returning pipe 44 and returns into the oil reservoir 17.

A discharge port 66*a* of the discharge pipe 66 extends from a joint portion 66*b* between the discharge pipe 66 and the hermetic container 10 into the gap space 71*a*.

As shown in FIG. 2, the discharge pipe 66 forms the bent portion 66*c* between the joint portion 66*b* and the discharge port 66*a*. According to this, the discharge port 66*a* is placed downward of the eddying flow from the joint portion 66*b*.

The discharge pipe 66 is jointed to the hermetic container 10 vertically. That is, the joint portion 66*b* of the discharge pipe 66 is jointed such that the joint portion 66*b* coincides with a radial direction of the hermetic container 10. An imaginary plumb line 66*a*Y of an opening surface formed on a discharge port 66*a* of the discharge pipe 66 is oriented to a circumferential direction of the hermetic container 10. That is, the imaginary plumb line 66*a*Y is oriented to a direction extending along the eddying flow.

In the drawing, an arrow R represents a rotational direction of the drive shaft 40, and the eddying flow of mixture fluid of refrigerant and lubrication oil is generated by rotation of the drive shaft 40.

Action of the hermetic electric compressor will be described below.

If the motor section 30 is driven, the rotor 32 rotates, thereby rotating the drive shaft 40. By the rotation of the drive shaft 40, the orbiting scroll 22 orbits around the fixed scroll 21. By the orbiting motion of the orbiting scroll 22, low pressure refrigerant is sucked from the suction pipe 65 into the compression chambers 23 located on the outer periphery. The low pressure refrigerant sucked into the compression chambers 23 is compressed by variation of volume of the compression chambers 23. The refrigerant which is compressed and whose pressure is increased is guided into the discharge hole 25 from the compression chambers 23 located at a center, the refrigerant opens the discharge valve 26 and the refrigerant is discharged into the discharge space 72.

The high pressure refrigerant which is discharged into the discharge space 72 passes through the vertical groove 64 provided in the fixed scroll 21 and the main frame 50, and flows out into the high pressure space 71 located below the main frame 50. The high pressure refrigerant which comes into the gap space 71*a* becomes eddying flow by rotation of the drive shaft 40, and the refrigerant passes through the discharge pipe 66 and is discharged to outside of the hermetic container 10.

Lubrication oil is mixed in the refrigerant which is compressed by the compressing mechanism 20 and discharged into the hermetic container 10. The lubrication oil becomes eddying flow together with the refrigerant in the gap space 71*a* between the compressing mechanism 20 and the motor section 30.

According to this embodiment, the discharge port 66*a* of the discharge pipe 66 is located downstream of the eddying flow from the joint portion 66*b*, and the discharge port 66*a* is provided in the direction opposite from the eddying flow. Therefore, fluid having a small lubrication oil content can be taken out from the discharge port 66*a* into the discharge pipe 66, and the discharge amount from the hermetic container 10 can be reduced.

Further, according to the embodiment, by forming the bent portion 66*c* on the discharge pipe 66, the discharge port 66*a* of the discharge pipe 66 can be placed downstream of the eddying flow from the joint portion 66*b*, and the discharge port 66*a* can be provided in the direction opposite from the eddying flow.

Further, according to the embodiment, since the discharge pipe 66 is vertically jointed to the hermetic container 10, the discharge pipe 66 can easily be jointed to the hermetic container 10.

Further, according to the embodiment, the imaginary plumb line 66*a*Y of the opening surface formed in the discharge port 66*a* is oriented to the circumferential direction of the hermetic container 10. Therefore, fluid having a small lubrication oil content can be taken out from the discharge port 66*a* into the discharge pipe 66, and the discharge amount from the hermetic container 10 can be reduced.

FIG. 3 is a sectional view of an essential portion of a side surface of a hermetic electric compressor according to another embodiment of the invention, and FIG. 4 is a sectional view of an essential portion of a plane of the hermetic electric compressor. Only portions which are different from those in FIGS. 1 and 2 are described below, and the same symbols are allocated to members having the same functions and description thereof is omitted.

According to the embodiment, the discharge pipe 66 from the joint portion 66*b* to the discharge port 66*a* is formed as a straight pipe, and the discharge port 66*a* extends into the gap space 71*a*.

As shown in FIG. 4, the discharge pipe 66 is obliquely jointed to the hermetic container 10 by the joint portion 66*b*. According to this, the discharge port 66*a* is placed downstream of the eddying flow from the joint portion 66*b*, and the discharge port 66*a* is provided in the direction opposite from the eddying flow.

In the discharge pipe 66, the imaginary plumb line 66*a*Y of the opening surface formed on the discharge port 66*a* is oriented to the circumferential direction of the hermetic container 10, i.e., the imaginary plumb line 66*a*Y is oriented to the direction extending along the eddying flow.

In the drawing, an arrow R represents a rotational direction of the drive shaft 40, and the eddying flow of mixture fluid of refrigerant and lubrication oil is generated by rotation of the drive shaft 40 in the gap space 71*a*.

According to this embodiment, the discharge port 66*a* of the discharge pipe 66 is placed downstream of the eddying flow from the joint portion 66*b*, and the discharge port 66*a* is provided in the direction opposite from the eddying flow. Therefore, fluid having a small lubrication oil content can be taken out from the discharge port 66*a* into the discharge pipe 66, and the discharge amount from the hermetic container 10 can be reduced.

According to the embodiment, the discharge pipe 66 is obliquely joint to the hermetic container 10 by the joint portion 66*b*. Therefore, the discharge port 66*a* of the discharge pipe 66 is placed downstream of the eddying flow from the joint portion 66*b*, and the discharge port 66*a* can be provided in the direction opposite from the eddying flow.

According to the embodiment, the discharge pipe 66 from the joint portion 66*b* to the discharge port 66*a* is formed as the straight pipe. Therefore, a bending operation of the discharge pipe 66 is unnecessary, and the discharge pipe 66 is easily inserted into the hermetic container 10.

According to the embodiment, the imaginary plumb line 66*a*Y of the opening surface formed on the discharge port 66*a* is oriented to the circumferential direction of the hermetic container 10. Therefore, fluid can be taken out from the discharge port 66*a* into the discharge pipe 66, and the discharge amount from the hermetic container 10 can be reduced.

INDUSTRIAL APPLICABILITY

The present invention can also be applied to a scroll hermetic electric compressor and a rotary hermetic electric compressor which are installed laterally.

DESCRIPTION OF SYMBOLS

10 hermetic container
11 trunk shell
12 lower shell
13 upper shell
14 terminal cover
15 power source supply terminal
16 inner bottom
17 oil reservoir
20 compressing mechanism
21 fixed scroll
21*a* panel plate
21*b* lap
22 orbiting scroll
22*a* panel plate
22*b* lap
23 compression chambers
24 boss
25 discharge hole
26 discharge valve
30 motor section
31 stator
32 rotor
40 drive shaft
41 eccentric shaft
42 oil supply passage
42*a* lateral hole
42*b* upper end opening
43 displacement oil pump
44 oil-returning pipe
50 main frame
51 main bearing (bearing portion)
52 boss-accommodating section
61 turning bearing
62 Oldham ring
63 screw
64 vertical groove
65 suction pipe
66 discharge pipe
66*a* discharge port
66*a*Y imaginary plumb line
66*b* joint portion
66*c* bent portion
71 high pressure space
71*a* gap space
71*b* lower high pressure space
72 discharge space
80 auxiliary bearing (bearing portion)
81 boss section
82 arm section
90 balancer
100 oil-receiving member
110 cover
R arrow

The invention claimed is:

1. A hermetic electric compressor comprising a compressing mechanism and a motor section provided in a hermetic container, in which the compressing mechanism and the motor section are connected to each other through a drive shaft, the compressing mechanism is placed on one side in the hermetic container, the motor section is placed on an other side in the hermetic container, the motor section is composed of an annular stator and a rotor that is rotatably provided on an inner side of the stator, a discharge pipe is placed in a gap space between the compressing mechanism and the motor section, a discharge port of the discharge pipe extends into the gap space from a joint portion between the discharge pipe and the hermetic container, the drive shaft is pivotally supported by a bearing portion, an oil reservoir is formed in an inner bottom of the hermetic container, an oil supply passage that guides lubrication oil stored in the oil reservoir into the compressing mechanism and the bearing portion is formed in the drive shaft, the drive shaft is provided with a balancer, the balancer is located below the compressing mechanism and above the motor section, an oil-receiving member receiving lubrication oil that drops toward the motor section is provided on an outer periphery of the balancer, a circumference of the balancer and the oil-receiving member are covered by a cover, refrigerant compressed in the compressing mechanism is discharged into the hermetic container, and the refrigerant discharged into the hermetic container becomes eddying flow in the gap space by rotation of the drive shaft, and is discharged to outside of the hermetic container from the discharge pipe, wherein the discharge port is placed downstream of the eddying flow from the joint portion, the discharge port is placed vertically above the stator without reaching vertically above the rotor, and the discharge port is placed at a same height as the cover.

2. The hermetic electric compressor according to claim 1, wherein a bent portion is formed between the joint portion and the discharge port.

3. The hermetic electric compressor according to claim 2, wherein, in the joint portion, the discharge pipe is vertically jointed to the hermetic container.

4. The hermetic electric compressor according to claim 1, wherein, in the joint portion, the discharge pipe is obliquely jointed to the hermetic container.

5. The hermetic electric compressor according to claim 4, wherein the discharge pipe from the joint portion to the discharge port is formed as a straight pipe.

6. The hermetic electric compressor according to claim 1, wherein an imaginary plumb line of an opening surface formed on the discharge port is oriented to a circumferential direction of the hermetic container.

* * * * *